US007123869B2

(12) United States Patent
Yamane et al.

(10) Patent No.: US 7,123,869 B2
(45) Date of Patent: Oct. 17, 2006

(54) COLOR IMAGE FORMING METHOD AND APPARATUS WITH IMAGE FLAW REDUCING SPEED CONTROL OF TONER IMAGE CARRIER PERIPHERAL VELOCITY

(75) Inventors: Shinji Yamane, Osaka (JP); Takeshi Watanabe, Osaka (JP); Akira Matayoshi, Osaka (JP); Katsuya Ota, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 173 days.

(21) Appl. No.: 10/927,524

(22) Filed: Aug. 27, 2004

(65) Prior Publication Data

US 2005/0123325 A1 Jun. 9, 2005

(30) Foreign Application Priority Data

Aug. 28, 2003 (JP) ..... 2003-305561
Aug. 29, 2003 (JP) ..... 2003-307088

(51) Int. Cl.
*G03G 15/16* (2006.01)

(52) U.S. Cl. ..... 399/297

(58) Field of Classification Search ..... 399/101, 399/302, 298, 297
See application file for complete search history.

(56) References Cited

U.S. PATENT DOCUMENTS 6,430,379 B1 * 8/2002 Takahashi et al. ..... 399/302

FOREIGN PATENT DOCUMENTS

JP 09258581 A * 10/1997
JP 2001117460 4/2001
JP 2002006577 1/2002

* cited by examiner

*Primary Examiner*—Susan Lee
(74) *Attorney, Agent, or Firm*—Crowell & Moring LLP

(57) ABSTRACT

Image transfer method and apparatus in which scratches due to entrainment of particles on an image carrier for a toner image having maximum spectroreflectivity at a wavelength of 550 nm do not produce perceptible flaws in resulting images transferred to a recording medium, since images formed with toner of maximum spectroreflectivity at 550 nm on white recording medium are difficult for human eyes to discern. When cleaning residual toner from transfer belts, reverse bias voltage is applied to at least one transfer roller, the peripheral velocity of the photosensitive drum on which a yellow toner image having maximum spectroreflectivity at 550 nm is formed is allowed to differ from the transfer velocity of the transfer belt, and at least the photosensitive drum on which the yellow toner image of maximum spectroreflectivity at 550 nm is formed is detached from the transfer belt.

11 Claims, 5 Drawing Sheets

COLOR IMAGE FORMING METHOD AND APPARATUS WITH IMAGE FLAW REDUCING SPEED CONTROL OF TONER IMAGE CARRIER PERIPHERAL VELOCITY

BACKGROUND OF THE INVENTION

1. Field of the Invention

The present invention is related to an image forming method in a copying machine, printer, facsimile machine, etc. and an apparatus using the method, particularly to a color image forming method of tandem type and an apparatus using the method.

2. Description of the Related Art

Generally, there is a full-color image forming apparatus using an intermediate image transfer belt (intermediate transfer body) composed such that toner images are superimposed sequentially on the intermediate transfer belt (primary image transferring) to form a color image, then the color image on the intermediate image transfer belt is transferred to a recording medium(recording sheet paper, hereafter referred to as a sheet paper) at a secondary image transferring position to obtain a sheet paper with the color image formed thereon. This kind of color image forming apparatus is called an intermediate tandem type image forming apparatus. On the other hand, there is an apparatus composed such that toner images are transferred sequentially on a sheet paper transferred on a sheet transfer belt to obtain a sheet paper with a color image formed thereon. This kind of color image forming apparatus is called a direct tandem type image forming apparatus. Hereinafter, both the intermediate image transfer belt and the sheet transfer belt are generically referred to as the transfer belt.

In the tandem type image forming apparatuses, the toner adhered to the transfer belt is cleaned periodically. When cleaning, the toner remaining on the transfer belt is removed for example by a cleaning mechanism provided with a blade or fur brush. However, it may happen through the cleaning of the transfer belt by the blade or fur brush that scuff marks (scratches) are produced on the transfer belt and normal image transfer can not be performed resulting in a faulty image formation.

There has been disclosed an image forming apparatus composed such that each image of yellow, magenta, cyan, and black toner is formed on each photosensitive drum and each image is transferred sequentially to a sheet paper transferred on the transfer belt, wherein, when performing the cleaning to remove the toner remaining on the transfer belt by reversely transferring the toner remaining on the transfer belt to at least one of the photosensitive drums, the difference between the peripheral velocity of the photosensitive drum to which the toner remaining on the transfer belt is reversely transferred and the transfer velocity of the transfer belt is 3% or larger in order to prevent the occurrence of a problem like that mentioned above (see Japanese Laid-Open Patent Application No. 2001-117460, hereafter referred to as patent literature 1).

Further, there has been disclosed an image forming apparatus composed such that the electric sources for applying bias voltage to transfer the second color and third color (magenta and cyan) among the electric sources for applying transfer bias voltage are capable of applying bias voltage of both positive and negative polarity to transfer the toner remaining on the transfer belt reversely to the photosensitive drums, a first cleaning mode and second cleaning mode are provided, in the first cleaning mode the peripheral velocity of the photosensitive drum coinciding with the transfer velocity of the transfer belt, in the second cleaning mode both the velocities differing by 10%, and the first cleaning mode and second cleaning mode can be switched to each other depending on the amount of the toner remaining on the transfer belt(see Japanese Laid-Open Patent Application No. 2002-6577, hereafter referred to as patent literature 2).

However, in the image forming apparatus disclosed in patent literature 1 or 2, as the cleaning of the transfer belt is performed by allowing the peripheral velocity of the photosensitive drum to be different from the transfer velocity of the transfer belt, if foreign matter is transferred together with a sheet paper for example from the sheet tray of the apparatus and the foreign matter intrudes in the gap between the photosensitive drum and transfer belt, scratch may produced on the surface of the photosensitive drum and transfer belt depending on the shape and hardness of the foreign matter. If the scratch is produced, faulty image may be formed when transferring image.

Further, with a photosensitive drum using organic photoconductor (OPC), the life of the photosensitive drum is extremely reduced by severe abrasion of the surface layer of the drum if the peripheral velocity of the photosensitive drum differs from the transfer velocity of the transfer belt as mentioned above. In the case of a photosensitive drum using amorphous silicon (a-Si), surface abrasion can be reduced, however, even the a-Si photosensitive drum can not cope with the abrasion produced by foreign matter intrusion, and faulty image formation occurs.

SUMMARY OF THE INVENTION

The present invention was made in light of the problems mentioned above, and the object of the invention is to provide a method and apparatus of forming image, with which, when cleaning the transfer belt, the transfer belt is cleaned well enough and flaws can not be perceived by human eyes in transferred images even if scratches are produced due to entrainment of foreign matter.

First, the process the inventors have reached the present invention will be explained. It is known that a range of wave length of visible light is about 380~880 nm, and human eyes are most sensitive to a range of 520~580, particularly to 550 nm. Accordingly, human eyes can sense light of near green to yellow easiest. However, when toner of color such as yellow is printed on a recording medium of white color, different phenomenon occurs. The specroreflectivity of white is about 100% all over the range of wave length of visible light, and that of yellow rises steeply at near 500 nm to be about 90% near 530 nm and it reaches near 100% above 600 nm as can be recognized from FIG. 6 showing specroreflectivity of cyan, magenta, and yellow. So yellow has specroreflectivity relatively like white that has about 100% specroreflectivity all over the range of wave length of visible light, when compared to other colors. Furthermore, yellow has the highest specroreflectivity (about 90%) among color toner of cyan, magenta, yellow, and black near 550 nm of wave length that is the wave length to which human eyes are most sensitive. Therefore, it is difficult for human eyes to distinguish yellow from white when yellow is printed on a white recoding medium. On the other hand, black is easiest to discern when printed on a white recoding medium, for specroreflectivity of black is about zero all over the range of wave length of visible light.

Therefore, yellow printed on a white recording medium is difficult to discern for human eyes.

As shown in FIG. 6 showing specroreflectivity of color toner of cyan, magenta, and yellow, specroreflectivity of cyan toner is a peak at near 470 nm but lower than 10% in a range between 580~720 nm. On the contrary, specroreflectivity of magenta toner is higher than 90% above 610 nm but lower than 10% in a range between 520~580 nm. (By the way, R in FIG. 6 indicates spectroreflectivity of red.)

The present invention is made on the basis of the knowledge mentioned above. The first substance of the present invention is to apply bias voltage of reverse polarity to at least one of the primary transfer rollers 9Y~9B, to allow the velocity difference between the peripheral velocity of the photosensitive drum 4Y on which a toner image difficult to be discerned when printed on a white recording medium (recording medium having high spectroreflectivity in the range of wave length of visible light), concretively toner image having spectroreflectivity relatively like white that has about 100% specroreflectivity all over the range of wave length of visible light compared to other colors is to be formed and the transfer velocity of the transfer belt 8 or intermediate transfer belt 8*a* to be increased to a value larger than a predetermined value, and to allow the peripheral velocity of the photosensitive drum 4B on which toner image of which spectroreflectivity is the lowest is to be formed to be controlled at about the same as the transfer velocity of the transfer belt 8 or intermediate transfer belt 8*a* (the first velocity control), when cleaning off the toner remaining on the transfer belt 8 or intermediate transfer belt 8*a* shown in FIG. 1 or FIG. 5 in order to perform cleaning of the transfer belt 8 or intermediate transfer belt 8*a* well enough.

The second substance of the present invention is to apply bias voltage of reverse polarity to at least one of the primary transfer rollers 9Y~9B, to allow the velocity difference between the peripheral velocity of the photosensitive drum 4Y on which toner image of which spectroreflectivity is the highest is to be formed and the transfer velocity of the transfer belt 8 or intermediate transfer belt 8*a* to be increased to a value larger than a predetermined value, and to allow the photo sensitive drum 4B on which toner image having the lowest spectroreflectivity is to be formed to be detached from the transfer belt 8 or intermediate transfer belt 8*a*, when cleaning off the toner remaining on the transfer belt 8 or intermediate transfer belt 8*a* shown in FIG. 1 or FIG. 5 in order to perform cleaning of the transfer belt 8 or intermediate transfer belt 8*a* well enough.

Any way, according to the present invention, flaws that can be perceived by human eyes do not appear in transferred images.

The present invention proposes an image forming method in an image forming apparatus provided with a plurality of image forming units having image carrying bodies for carrying toner images of several colors, the image forming units being arranged along a transfer body for transferring recording medium, and a plurality of image transfer means each faces each of said image carrying body across said image transfer body pinching the image transfer body, wherein, when cleaning off the toner remaining on said transfer body, a first speed control is done to allow the peripheral velocity of an image carrying body on which a toner image of which the spectroreflectivity at wavelength of 550 nm is the highest is to be formed to be different from the transfer velocity of said transfer body in a state a bias voltage is applied to the transfer means corresponding to said image carrying body on which a toner image of which the spectroreflectivity at wavelength of 550 nm is the highest is to be formed, the polarity of said bias voltage being opposite to that of a bias voltage that is applied when the image on said image carrying body on which a toner image of which the spectroreflectivity at wavelength of 550 nm is the highest is to be formed is transferred to said recording medium.

It is suitable that before performing said first speed control a second speed control by which each peripheral velocity of all the image carrying bodies is allowed to be about the same as the transfer velocity of the transfer body is performed.

It is also suitable that said first speed control is performed and at least the image carrying body on which a toner image of which the spectroreflectivity at wavelength of 550 nm is the lowest is to be formed is detached from the transfer body.

The present invention proposes an image forming apparatus provided with a plurality of image forming units having image carrying bodies for carrying toner images of several colors, the image forming units being arranged along a transfer body for transferring recording medium, and a plurality of image transfer means each faces each of said image carrying body across said image transfer body pinching the image transfer body, wherein are provided a reverse bias applying means for applying the bias voltage opposite in polarity to that applied to when the image on the image carrying body is transferred to the recording medium to at least one of the transfer means, preferably to the transfer means corresponding to the image carrying body on which a toner image of which the spectroreflectivity at wavelength of 550 nm is the highest is to be formed, and a control means which can perform speed control of a first speed control mode for controlling the peripheral velocity of an image carrying body of highest spectroreflectivity to be different from the transfer velocity of said transfer body when cleaning off the toner remaining on said transfer body.

It is suitable that said control means can perform a second control mode by which peripheral velocities of all the image carrying bodies are allowed to be about the same as the transfer velocity of the transfer body before said first speed control is performed when cleaning off the toner remaining on the transfer body.

It is also suitable that said first control mode is to control so that the velocity difference between the peripheral velocity of an image carrying body on which a toner image of which the spectroreflectivity at wavelength of 550 nm is the highest is to be formed and the transfer velocity of the transfer body is larger than a predetermined value, and to control to allow to detach from the transfer body at least an image carrying body on which a toner image of which the spectroreflectivity at wavelength of 550 nm is the lowest (image of black group toner) is to be formed is detached from the transfer body.

It is suitable particularly when in said first control mode only the image carrying body on which a toner image of which the spectroreflectivity at wavelength of 550 nm is the lowest is to be formed is detached from the transfer body, said control means controls so that the peripheral velocity of each of the image carrying bodies except the image carrying body on which a toner image of which the spectroreflectivity at wavelength of 550 nm is the lowest is to be formed is about the same as the velocity of the transfer body.

Further, it is suitable that said first control mode is to control to allow the velocity difference between the peripheral velocity of an image carrying body on which a toner image of which the spectroreflectivity at wavelength of 550 nm is the highest is to be formed and the transfer velocity of the transfer body to be larger than a predetermined value and to control to allow the peripheral velocity of at least an image carrying body on which a toner image of which the spectroreflectivity at wavelength of 550 nm is the lowest is to be formed to be about the same as the transfer velocity of the transfer body.

As the image carrying body is brought into frictional contact with the intermediate transfer body, it is preferable that amorphous silicon photoconductor is used, which is less apt to be scratched by toner image.

As has been mentioned in the forgoing, according to the present invention, even if scratches are produced on the image carrying body on which a toner image of which the spectroreflectivity at wavelength of 550 nm is the highest is to be formed, the image transferred to recording medium is not perceived to have a flaw, for the image formed with the toner of highest spectroreflectivity is difficult for human eyes to discern. Therefore, the invention bring about effect that not only the transfer body can be fully cleaned but flaws do not appear practically in transferred images even if scratches are produced due to entrainment of foreign matter.

Further, in the present invention, as the second control mode by which the peripheral velocities of all the image carrying bodies are controlled to be about the same as the transfer velocity of the transfer body before performing the first control mode when cleaning off the toner remaining on the transfer body, foreign matter adhered electrostatically to the transfer body is reversely transferred to any one of the image carrying bodies, and generation of scratches can be prevented or suppressed to a minimum when shifted to the first control mode.

With an image forming apparatus using intermediate transfer body, the intermediate transfer body can be fully cleaned similarly, and even if scratches are produced due to entrainment of foreign matter, flaws do not appear practically in transferred images.

DETAILED DESCRIPTION OF THE PREFERRED EMBODIMENTS

A preferred embodiment of the present invention will now be detailed with reference to the accompanying drawings. It is intended, however, that unless particularly specified, dimensions, materials, relative positions and so forth of the constituent parts in the embodiments shall be interpreted as illustrative only not as limitative of the scope of the present invention.

Figure 1:
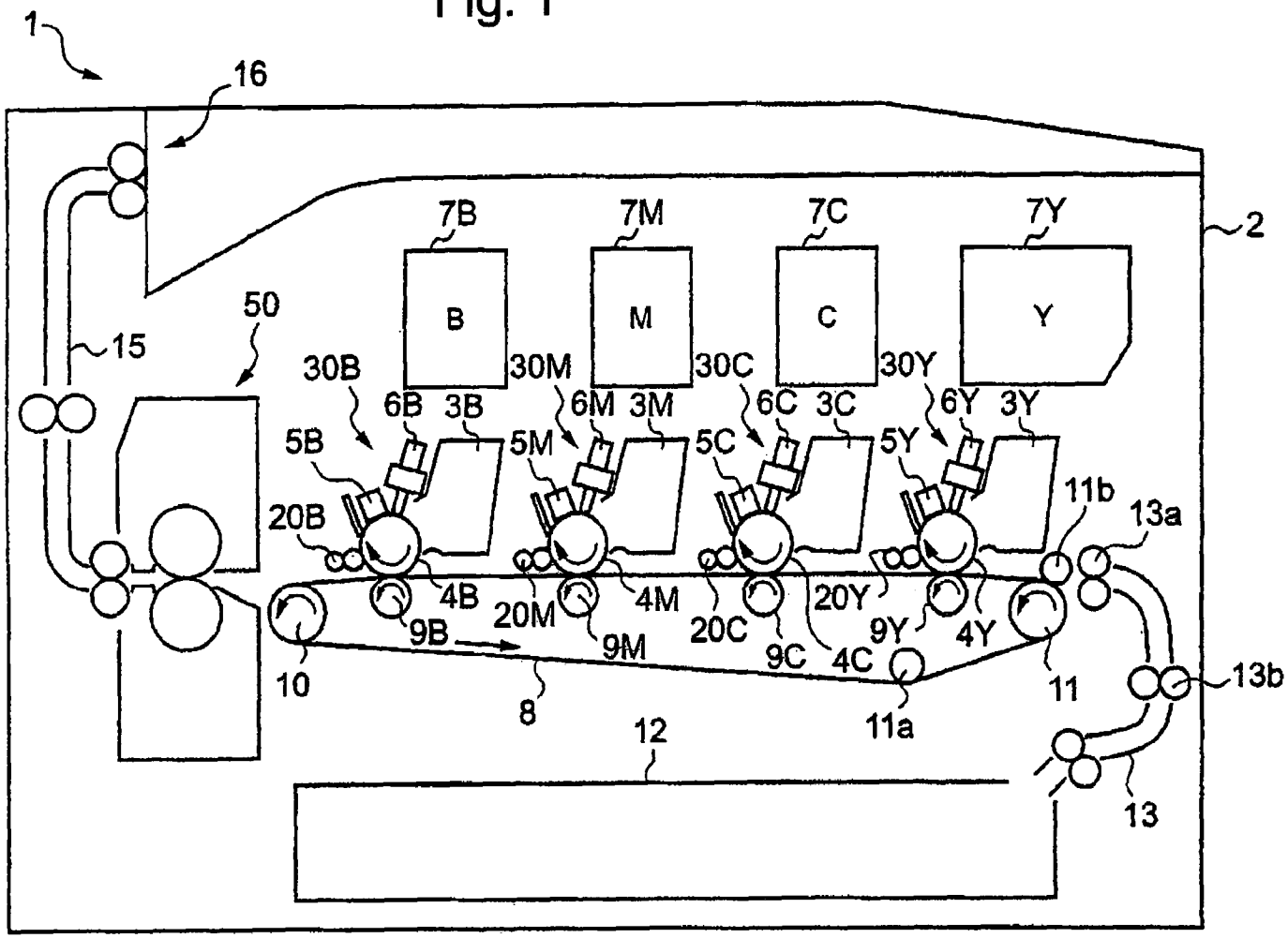
FIG.1 is a schematic representation of an embodiment of the image forming apparatus according to the present invention.

FIG. 1 is a schematic representation of an example of direct tandem type color printer used as a image forming apparatus. In the printer 1, a full-color image output or mono-color image output is selected depending on the color information of original image data sent from an external computer(not shown in the drawing). A sheet transfer belt 8 (intermediate transfer belt) made of poly-vinylidene-fluoride (PVDF) for example is provided in the housing 2 of the printer 1 for transferring sheet papers, the sheet transfer belt 8 is looped over a driving roller 10, a follower roller 11, and an opposite-side roller 11*a* to be driven by the driving roller 10 to travel in the direction shown by the arrow in FIG. 1. The outlet side of a sheet feed passage 13 is located at an end side of the sheet transfer belt 8 (right side in the drawing and hereafter referred to as sheet receiving side), a pair of registration rollers 13*a* is located at the outlet of the sheet feed passage 13, the sheet receiving side is positioning downstream of the registration rollers 13*a*.

A pair of sheet transfer roller 13*b* is located in the sheet feed passage 13, and a sheet cassette 12 is provided downstream of the sheet feed passage 13. On the other hand, a fusing device 50 is provided at the other end side of the sheet transfer belt 8, the outlet side of the fusing device 50 is connected to a sheet discharging passage 15 which continues to a sheet discharging part 16 provided at the upper part of the housing 2.

Four image forming units 30Y, 30C, 30M, and 30B are located along the sheet transfer belt 8 sequentially from upstream side of transfer. In the example shown in FIG. 1, the image forming unit 30Y for yellow, the image forming unit 30C for cyan, the image forming unit 30M for magenta, and the image forming unit 30B for black are arranged along the sheet transfer belt 8 sequentially from upstream. Here, paying attention to the image forming unit 30Y, the image forming unit 30Y is provided with a photosensitive drum 4Y having amorphous silicon (a-Si) as a photoconductor for example, and an electrostatic charger 5Y, a LED print head unit 6Y, a developing device 3Y, and a cleaning device 20Y are located around the photosensitive drum 4Y.

When forming image, the surface of the photosensitive drum 4Y is charged uniformly by the electrostatic charger 5Y, and the LED print head unit 6Y irradiates the surface of the photosensitive drum 4Y with the light from the LED in accordance with the original image data. By this, an electrostatic latent image corresponding to the original image is formed on the surface of the photosensitive drum 4Y. The electrostatic latent image is developed by the developing device 3Y and a toner image is formed on the photosensitive drum 4Y.

The image forming units 30C, 30M, and 30B are respectively provided with photosensitive drum 4C, 4M, and 4B; electrostatic charger 5C, 5M, and 5B; LED print head unit 6C, 6M, and 6B; developing device 3C, 3M, and 3B; and cleaning device 20C, 20M, and 20B. Each of the transfer rollers 9Y, 9C, 9M, and 9B is located to face each of the photosensitive drums 4Y, 4C, 4M, and 4B across the sheet transfer belt 8 pinching the sheet transfer belt 8 with each of the photosensitive drums 4Y, 4C, 4M, and 4B. These transfer rollers 9Y~9B support the sheet transfer belt 8 and serve to allow the sheet transfer belt 8 to contact the photosensitive drums 4Y~4B, and toner images on the photosensitive drums 4Y~4B are transferred to the sheet carried on the sheet transfer belt 8 as mentioned later. When the toner in the developing devices 3Y, 3C, 3M, and 3B is consumed for developing latent images, toner is supplied from toner containers 7Y, 7C, 7M, and 7B to the developing devices 3Y, 3C, 3M, and 3B respectively to keep always a proper amount of developing agent (toner) to be contained in each of the developing devices 3Y, 3C, 3M, and 3B.

When forming an image, the photosensitive drums 4Y~4B are allowed to contact the sheet transfer belt 8, facing the transfer rollers 9Y~9B across the sheet transfer belt 8 pinching the sheet transfer belt 8 with the transfer rollers 9Y~9B, the sheet paper fed from the sheet cassette 12 through the sheet feeding passage 13 is allowed to be adsorbed onto the sheet transfer belt 8 by means of an adsorption roller 13*b* to be transferred on the sheet transfer belt 8 in the direction shown by the arrow in FIG. 1. The transfer velocity of the sheet transfer belt 8 is about the same as the peripheral velocity of the photosensitive drums 4.

When the sheet paper on the sheet transfer belt 8 passes under the photosensitive drums 4Y, the toner adhered to the photosensitive drums 4Y is attracted toward the sheet paper and the toner image is transferred to the sheet paper by the bias voltage applied to the transfer roller 9Y. After yellow toner image is transferred onto the sheet paper in this manner at the image forming unit 30Y, each of toner images of cyan, magenta, and black is transferred onto the sheet paper sequentially at the image forming unit 30C, 30M, and 30B respectively, thus toner images of each color are superimposed on the sheet paper. As a result, a color image is transferred onto the sheet paper. Then, the sheet paper is transferred to the fusing device 50 whereby the color image is fused and fixated on the sheet paper, and the sheet is discharged to the sheet discharge part 16 by way of the sheet discharging passage 15.

By the way, although not shown in FIG. 1, a color registration sensor and an image density correction sensor are located in the downstream side from the driving roller 10 for correcting color drift and image density, and correction of color drift and image density are performed at a predetermined time interval. Cleaning of the sheet transfer belt 8 is carried out automatically after collecting color drift and image density and after a jammed sheet paper is treated or manually when the contamination of the rear side of sheet paper is conspicuous as described in the following: The sheet transfer belt 8 is cleaned by applying a reverse transfer bias voltage opposite in polarity to that applied when transferring a toner image to the sheet paper to one or more of the transfer rollers including at least the transfer roller 9Y among the transfer rollers 9Y~9B, in this embodiment to the transfer roller 9Y of yellow, in order to transfer the toner on the sheet transfer belt 8 to the photosensitive drum 4Y, the photosensitive drum 4Y being not charge at this time.

Next, the operation of the first control mode of the first embodiment will be explained hereunder.

First, referring to FIG. 2, a controller (not shown in the drawings) controls, when cleaning the sheet transfer belt 8, the peripheral velocity of the photosensitive drums 4Y~4B and the transfer velocity of the sheet transfer belt 8 as described in the following: Now, when the controller controls the transfer velocity of the sheet transfer belt 8 at v (mm/s) when cleaning the sheet transfer belt 8, the controller controls the peripheral velocity of the photosensitive drums 4Y~4B at about v mm/s (the second speed control). Then, the controller controls the peripheral velocity of the photosensitive drum 4Y to be reduced to about v/2 mm/s when the sheet transfer belt 8 comes in second round while keeping the peripheral velocities of the photosensitive drums 4C~4B at about v mm/s (the first speed control). Hereunder, the control mode of the first speed control, second speed control, and the control of applying to the transfer roller 9 a reverse transfer bias voltage opposite in polarity to that applied when transferring an image to the sheet paper to allow the toner on the sheet transfer belt 8 to be transferred reversely to the photosensitive drum 4Y which is in the state not charged, are together referred to as the first cleaning control mode.

When the difference between the peripheral velocity of the photosensitive drum 4Y and the transfer velocity of the sheet transfer belt 8 increases, the toner is drawn by the friction force caused by the velocity difference and effect of van der Waals attraction between the surface of the sheet transfer belt 8 and the toner adhered thereon becomes small, and the toner is effected stronger by the electric field. As a result, the cleaning ability of the bias voltage increases dramatically with the increase in velocity difference. Therefore, the toner not removed in the first round of the sheet transfer belt 8 is removed easily from the sheet transfer belt 8. Superior cleaning performance can be achieved by increasing the velocity difference between the peripheral velocity of the photosensitive drum and transfer belt, however, friction force is increased and the contacting part may be abraded, resulting in damaged surfaces of the drum and belt. For this reason, cleaning by the first cleaning mode is performed when it is supposed that a large amount of toner is remained on the transfer belt as mentioned above.

Figure 2:
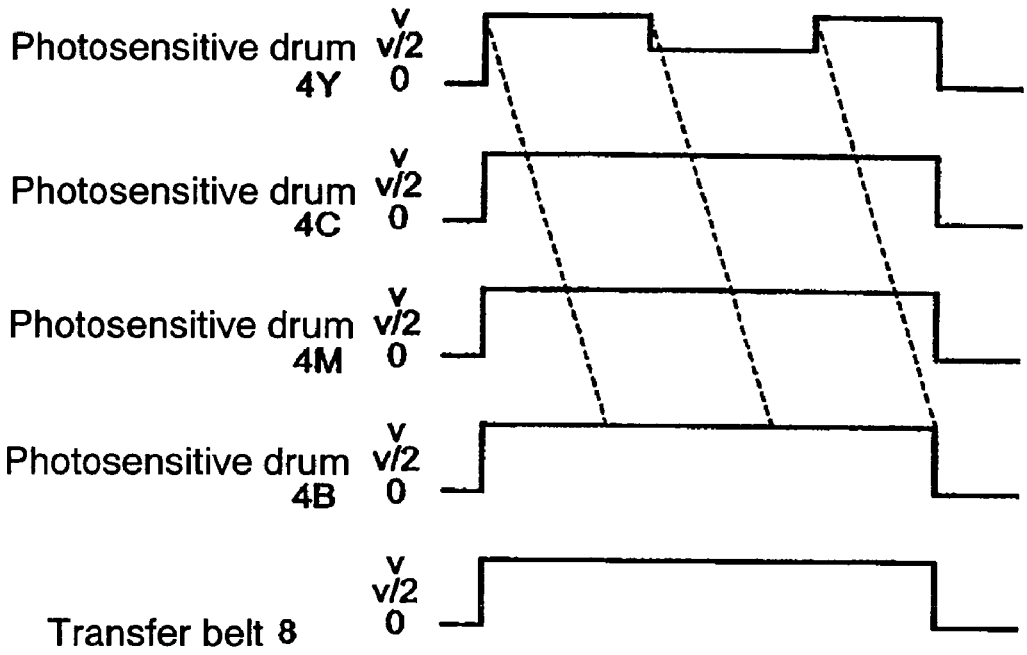
FIG. 2 is a representation showing the relation between the transfer velocity of the transfer belt and the peripheral velocity of the photosensitive drum when cleaning the transfer belt in the image forming apparatus of FIG. 1, the relation showing the case of a first embodiment of controlling.

In the example shown in FIG. 2, the peripheral velocity of the photosensitive drum 4Y is again increased at v mm/s when the sheet transfer belt 8 comes to the third round, and the cleaning is finished when the sheet transfer belt 8 finishes the third round. It is permissible not to carry out the cleaning of the third round.

Further, the second cleaning mode is established in the controller in addition to said first cleaning mode. When performing regular image forming, the cleaning of the sheet transfer belt 8 is done by the second cleaning mode. In the second cleaning mode, the peripheral velocity of the photosensitive drums 4Y~4B is controlled at about v mm/s, reverse transfer bias voltage is applied to at least one of the transfer rollers 9Y~9B, and cleaning finishes when the sheet transfer belt 8 finishes one round (in the second cleaning mode, the reverse transfer bias is applied to at least one of the transfer rollers 9Y~9B).

For example, in the second cleaning mode, the peripheral velocity of the photosensitive drums 4Y~4B is set at v1=115.65 mm/s, the transfer velocity of the sheet transfer belt 8 is set at v2=116.00 mm/s, i.e. the peripheral velocity of the photosensitive drums 4Y~4B and the transfer velocity of the sheet transfer belt 8 are about the same (speed difference is 0.3%). This is the same setting as that when forming an image.

Now assuming that the width a at the transfer nip is 1.5 mm, the time dt for the sheet transfer belt 8 to pass through the transfer nip is 0.0129 seconds. In the second cleaning mode, length dL of a scratch produced by entrained foreign matter is: $dL=a\times(v2-v1)/v2=0.0045$ mm. In the embodiment, foreign matter of several dozens of μm in size is considered. When foreign matter large in size such as a staple is entrained, a scratch of about same size of the foreign matter is produced on the surface of the photosensitive drum and transfer belt, and it is necessary to replace both the drum and belt. With resolution of 600 dpi, the length of a pixel is 42 μm, and scratches that cause flaws in the image transferred onto a sheet paper are not generated. On the other hand, in the first cleaning mode, as the peripheral velocity of the photosensitive drum 4Y is reduced to about half of the transfer velocity of the sheet transfer belt 8, scratch length dL is: $dL=a\times(v2-v1)/v2=0.752$ mm. Although the length of scratch is increased, yellow toner is used on the photosensitive drum 4Y, so it is difficult to discern the scratch by human eyes, that is, visual sensibility of yellow is extremely low and the scratch may hardly be recognized as a flaw by human eyes. As a result, the transfer belt can be fully cleaned without causing a flaw in the image transferred onto a sheet paper. The result of an endurance test using the first cleaning mode by printing 300,000 sheet papers showed that the wear of the surface of the photosensitive drums 4Y~4B and sheet transfer belt 8 was a level that does not cause problems on image forming performance.

Another test was carried out for comparison while cleaning the sheet transfer belt 8 by setting each of the peripheral velocities of the photosensitive drums 4Y~4B at a same velocity and setting the transfer velocity of the sheet transfer belt 8 at 2 times the peripheral velocity of the photosensitive drums 4Y~4B. The result was that, although cleaning was well enough, scratches of about 700~800 μm were produced on the surface of the photosensitive drums 4Y~4B and flaws recognizable by human eyes were perceived in the transferred image. In the direct tandem type image forming apparatus, as images are transferred from the photosensitive drums 4Y~4B directly onto a sheet paper, flaws in transferred images when foreign matter is entrained are increased in size.

In the foregoing example of the case of using a-Si photosensitive drums for the photosensitive drums 4Y~4B has been explained. The result of endurance test in which organic photoconductors (OPC) were used instead of a-Si photosensitive drums and cleaning were performed by the first cleaning mode showed that, although many scratches were produced on the surface of the photosensitive drum 4Y when foreign matter is entrained, flaws recognizable by human eyes were not perceived in the transferred images. However, wear were significant on the photosensitive layer of the drum and surface potential decreased, as a result severe fogging happened to the transferred images.

Another test was carried out by using organic photoconductors (OPC) for comparison while cleaning the sheet transfer belt 8 by setting the peripheral velocity of the photosensitive drums 4Y~4B at the same velocity to each other and setting the transfer velocity of the sheet transfer belt 8 at 2 times the peripheral velocity of the photosensitive drums 4Y~4B. The result was that many scratches were produced on the surfaces of the photosensitive drums 4Y~4B when foreign matter is entrained, flaws recognizable by human eyes were perceived in the transferred images, wear were significant on the surface of the photosensitive layers of the drums and surface potential decreased, as a result severe fogging happened to the transferred images.

By the way, representing the width of transfer nip by a (mm), the peripheral velocity of the photosensitive drums 4Y~4B by v1 (mm/s), the transfer velocity of the sheet transfer belt 8 by v2 (mm/s), the time for the sheet transfer belt 8 to pass through the nip by dt (s), and the length of scratch when foreign matter is entrained by dL, there are relations between them as follows:

$$dt=a/v2$$

$$dL=a\times(v1-v2)/v2, \text{ when } v1\geqq v2, \text{ and}$$

$$dL=a\times(v2-v1)/v2, \text{ when } v1<v2.$$

Now, we define k=1+(v1−v2)/v2 as velocity difference rate.

When it is assuming that limit scratch length Lc (permissible scratch length) is the same as the length of a pixel, it was found that a scratch which causes a flaw in a transferred image is prevented from occurring when the peripheral velocity of the photosensitive drums 4Y~4B is set most near to the transfer velocity of the sheet transfer belt in a range that k>1−Lc/a when v1≧v2, and in a range that k<1+Lc/a when v1<v2.

It was proved that, if the peripheral velocity of the photosensitive drum 4Y~4B and the transfer velocity of the sheet transfer belt 8 are set at about the same velocity to each other in the range mentioned above, a scratch of such size which causes a flaw in transferred images is not produced even if hard and edged foreign matter is entrained and bites into either the of the photosensitive drum 4Y~4B and sheet transfer belt 8.

In the foregoing example, the peripheral velocity of the photosensitive drum 4Y~4B is set to about the same to the transfer velocity of the sheet transfer belt 8 (the second speed control) and then the peripheral velocity of the photosensitive drum 4Y is changed to about half of the transfer velocity of the sheet transfer belt 8 (the first speed control) when cleaning is performed by the first cleaning mode, but it is also suitable in the first cleaning mode to set the peripheral velocity of the photosensitive drum 4Y to about half of the transfer velocity of the sheet transfer belt 8 from the beginning of cleaning, which mean that only the first speed control is done.

In this way, by performing cleaning by setting the peripheral velocity of the photosensitive drum 4Y at about half of the transfer velocity of the sheet transfer belt 8, the sheet transfer belt 8 can be fully cleaned, and even if a scratch is produced, yellow is difficult to be perceived by human eyes, so it is hardly be sensed as a flaw in the transferred image by human eyes and flaws can be practically prevented from appearing in the transferred image.

By the cleaning by setting the peripheral velocity of the photosensitive drum 4Y~4B to be about the same as the transfer velocity of the sheet transfer belt 8 as mentioned above before the peripheral velocity of the photosensitive drum 4Y is changed to be about half of the transfer velocity of the sheet transfer belt 8, the foreign matter adhered electrostatically to the sheet transfer belt 8 is transferred to either of the photosensitive drum 4Y~4B, and generation of scratches can be prevented or suppressed to a minimum. After this, cleaning is done by changing the peripheral velocity of the photosensitive drum 4Y to about half of the transfer velocity of the sheet transfer belt 8, so the foreign matter remained on the sheet transfer belt 8 is removed (reversely transferred) and flaws in the transferred images can not be sensed as flaws even if scratches are generated, for yellow is difficult to be perceived by human eyes.

In the above example, although the peripheral velocity of only the photosensitive drum 4Y is controlled at about half of the transfer velocity of the sheet transfer belt 8, it was approved that, in an image forming apparatus transferring several colors, a result similar to that mentioned above can be achieved by allowing the velocity difference between the peripheral velocity of the photosensitive drum on which a toner image of which the spectroreflectivity at wavelength of 550 nm is the highest is to be formed (hereafter referred to as the highest spectroreflectivity image carrying photosensitive drum) and the transfer velocity of the sheet transfer belt 8 is set to about 20% or larger. It is not necessarily needed to set the peripheral velocity of the highest spectroreflectivity image carrying photosensitive drum to about half of the transfer velocity of the sheet transfer belt 8, it is permissible to control the peripheral velocity of the highest spectroreflectivity image carrying photosensitive drum so that the velocity difference between the peripheral velocity of the highest spectroreflectivity image carrying photosensitive drum and the transfer velocity of the sheet transfer belt 8 is maximum.

Although in the above-mentioned example the peripheral velocity of each of the photosensitive drums 4C~4B except the photosensitive drum 4Y is controlled at about the same velocity as the transfer velocity of the sheet transfer belt 8, it is suitable to control at least the peripheral velocity of only the photosensitive drum 4B at about the same velocity as the transfer velocity of the sheet transfer belt 8. By controlling the peripheral velocity of the photosensitive drum 4B at about the same velocity as the transfer velocity of the sheet transfer belt 8, scratches are not produced on the surface of the photosensitive drum 4B even if foreign matter is entrained and flaws do not appear in the transferred image, nevertheless black toner is easily appreciated by human eyes. In an image transfer apparatus transferring images of several colors, it is suitable to allow the peripheral velocity of the photosensitive drum on which a toner image of which spectroreflectivity at wavelength of 550 nm is the lowest is to be formed (hereafter referred to as the lowest spectroreflectivity image carrying photosensitive drum) to be about the same as the transfer velocity of the sheet transfer belt 8.

That is, in the above-mentioned example, by allowing the velocity difference between the peripheral velocity of the highest spectroreflectivity image carrying photosensitive drum and the transfer velocity of sheet transfer belt 8 to be larger than the velocity difference between the peripheral velocity of the photosensitive drum other than the highest spectroreflectivity image carrying photosensitive drum and the transfer velocity of sheet transfer belt 8, and allowing the peripheral velocity of at least the lowest spectroreflectivity image carrying photosensitive drum to be about the same as the transfer velocity of the sheet transfer belt 8 when cleaning the sheet transfer belt 8, the cleaning can be done well enough, and even if foreign matter is entrained, flaws do not be perceived in the transferred image.

In the above-mentioned example, the image transfer units 30Y, 30C, 30M, and 30B are arranged from upstream toward downstream in this ordering, it is permissible to arrange them in any other ordering. However, it is desirable that the image forming unit 30Y is located most upstream and the unit 30B most downstream or that the image forming unit 30B is located most upstream and the unit 30Y most downstream.

Next, the operation of the second control mode of the first embodiment of FIG. 1 will be explained hereunder.

Figure 3:
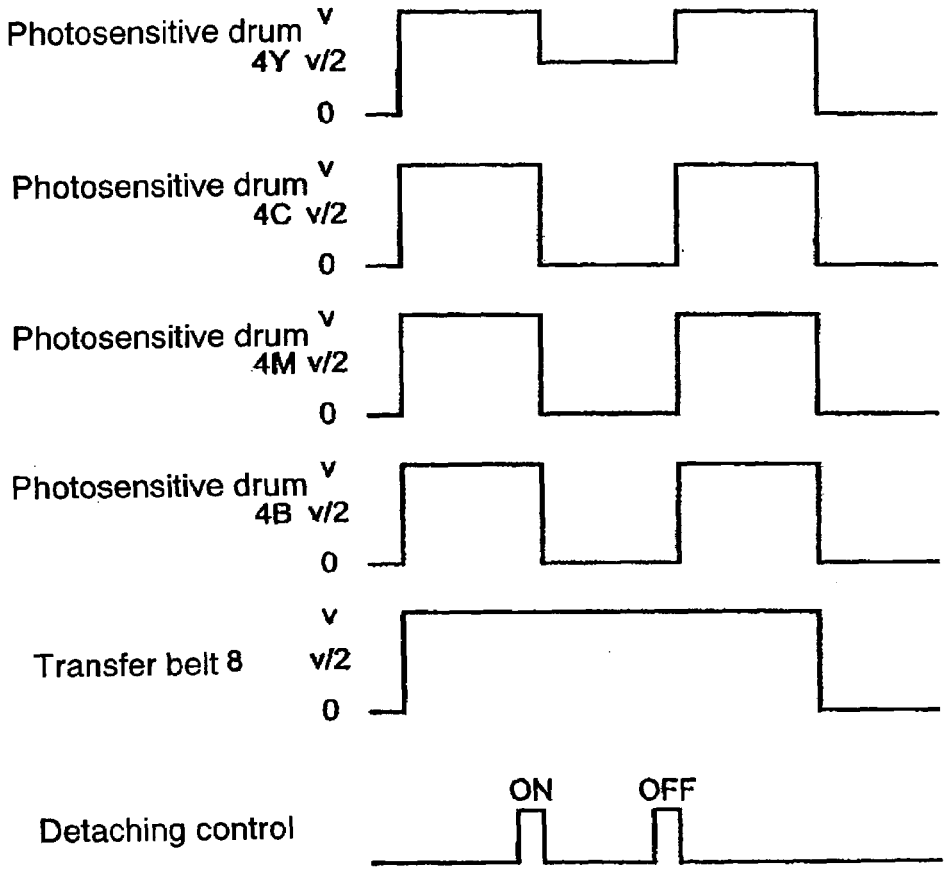
FIG. 3 is a representation showing the relation between the transfer velocity of the transfer belt, the peripheral velocity of the photosensitive drum, and distancing of the photosensitive drums from the transfer belt when cleaning the transfer belt in the image forming apparatus of FIG. 1, the relation showing the case of a second embodiment of controlling.

Referring to FIG. 3, when cleaning the sheet transfer belt 8, a controller (not shown) controls the peripheral velocity of the photosensitive drum 4Y~4B and the transfer velocity of the sheet transfer belt 8 as follows:

Now, assuming the controller controls the transfer velocity of the sheet transfer belt at v mm/s when cleaning, the controller controls the peripheral velocity of the photosensitive drum 4Y~4B at about v mm/s (the second control mode, in this second control mode the velocity difference between the peripheral velocity of the photosensitive drum 4Y and the transfer velocity of the sheet transfer belt 8 being a predetermined value).

At the time when the sheet transfer belt 8 enters into the second round and in the state the photosensitive drum 4Y is not charged, a reverse transfer bias voltage is applied to the transfer roller 9Y corresponding to the photosensitive drum 4Y, the reverse transfer bias voltage being opposite in polarity to that of the bias voltage applied to the transfer roller 9Y when transferring an image, the peripheral velocity of the photosensitive drum 4Y is reduced to about half of the transfer velocity of the sheet transfer belt 8 (the first speed control, in this first speed control the velocity difference between the peripheral velocity of the photosensitive drum 4Y and the transfer velocity of the sheet transfer belt 8 being larger than a predetermined value mentioned above), and the photosensitive drums 4C~4B are detached from the sheet transfer belt 8 and their peripheral speeds become zero.

Figure 4:
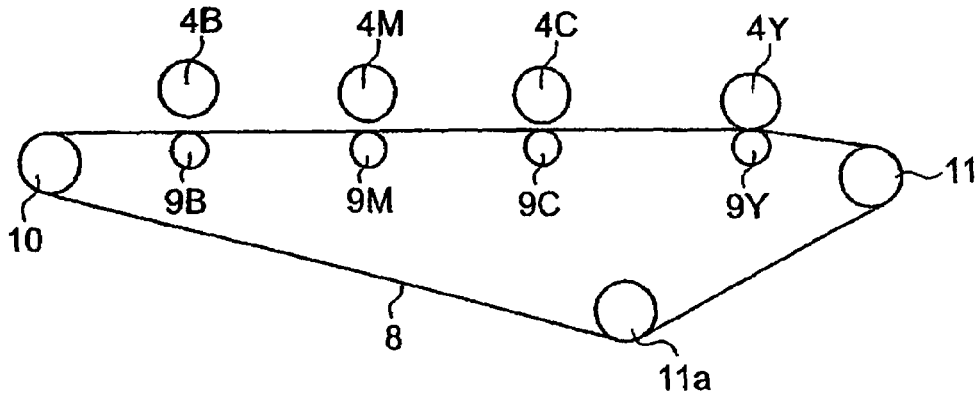
FIG. 4 is a representation showing the state the photosensitive drums are distanced from the transfer belt in the case of controlling shown in FIG.3.

When detaching the photosensitive drums 4C~4B from the sheet transfer belt 8, the controller allows the transfer belt unit including the sheet transfer belt 8 to be rotated in the counterclockwise direction around the center axis of the follower roller 11 as shown in FIG. 4. As a result, only the photosensitive drum 4Y faces the transfer roller 9Y pinching the sheet transfer belt 8 with the transfer roller 9Y. A reverse transfer bias voltage is applied to the transfer roller 9Y, the toner on the sheet transfer belt 8 is transferred reversely to the photosensitive drum 4Y, and the sheet transfer belt 8 is cleaned.

It is suitable to pull down the transfer rollers 9C, 9M, and 9B so that they do not pinch the sheet transfer belt 8 with the photosensitive drum 4C~4B respectively.

When the velocity difference between the photosensitive drum 4Y and the sheet transfer belt 8 increases, the toner is drawn by the friction force caused by the velocity difference and effect of van der Waals attraction becomes small, the toner is effected stronger by the electric field, and the cleaning ability of the bias voltage increases dramatically with the increase in velocity difference. As a result, the toner not removed in the first round of the sheet transfer belt 8 can be removed easily from the sheet transfer belt 8.

In the example shown in FIG. 3, the peripheral velocity of the photosensitive drum 4Y is again increased to v mm/s when the sheet transfer belt 8 comes to the third round, the detachment of the photosensitive drum 4C~4B are canceled and their peripheral speeds become again v mm/s, further cleaning is done, and cleaning is finished when the sheet transfer belt 8 finishes the third round. It is permissible not to carry out the cleaning of the third round.

Further, the second cleaning mode is established in the controller in addition to said first cleaning mode. When performing regular image forming, the cleaning of the sheet transfer belt 8 is done by the second cleaning mode. In the second cleaning mode, the peripheral velocity of each of the photosensitive drums 4Y~4B is controlled at about v mm/s, reverse transfer bias voltage is applied to at least one of the transfer rollers 9Y~9B, and cleaning finishes when the sheet transfer belt 8 finishes one round.

For example, in the second cleaning mode, the peripheral velocity of each of the photosensitive drums 4Y~4B is set at v1=115.65 mm/s, the transfer velocity of the sheet transfer belt 8 is set at v2=116.00 mm/s, i.e. the peripheral velocity of the photosensitive drums 4Y~4B and the transfer velocity of the sheet transfer belt 8 are about the same (speed difference is 0.3%). This is the same setting as that when image forming.

Now assuming that the width a at the transfer nip is 1.5 mm, the time dt for the sheet transfer belt 8 to pass through the transfer nip is 0.0129 seconds. In the second cleaning mode, length dL of a scratch produced by entrained foreign matter is: $dL=a\times(v2-v1)/v2=0.0045$ mm. In the embodiment, foreign matter of several dozens of μm in size is considered. When foreign matter large in size such as a staple is entrained, a scratch of about same size of the foreign matter is produced on the surface of the photosensitive drum and sheet transfer belt, and it is necessary to replace both the drum and belt. With resolution of 600 dpi, the length of a pixel is 42 μm, and scratches that cause flaws in the image transferred onto a sheet paper are not generated. On the other hand, in the first cleaning mode, as the peripheral velocity of the photosensitive drum 4Y is reduced to about half of the transfer velocity of the sheet transfer belt 8, scratch length dL is: $dL=a\times(v2-v1)/v2=0.752$ mm. Although the length of scratch is increased, yellow toner is used on the photosensitive drum 4Y, so it is difficult to discern the scratch by human eyes, that is, visual sensibility of yellow is extremely low and the scratch may hardly be recognized as a flaw by human eyes. As a result, the sheet transfer belt 8 can be fully cleaned without causing a flaw in the image formed. The result of an endurance test using the first cleaning mode by printing 300,000 sheet papers showed that the wear of the surface of the photosensitive drums 4Y~4B and sheet transfer belt 8 was a level that does not cause problems on image forming performance.

Another test was carried out for comparison while cleaning the sheet transfer belt 8 by setting the peripheral velocity of each of the photosensitive drums 4Y~4B at a same velocity and setting the transfer velocity of the sheet transfer belt 8 at 2 times the peripheral velocity of the photosensitive drums 4Y~4B. The result was that, although cleaning was well enough, scratches of about 700~800 μm were produced on the surface of the photosensitive drums 4Y~4B and flaws recognizable by human eyes were perceived in the transferred image. In the direct tandem type image forming apparatus, as images are transferred from the photosensitive drums 4Y~4B directly to a sheet paper, flaws in transferred images when foreign matter is entrained are increased in size.

In the foregoing, examples of the case of using a-Si photosensitive drums for the photosensitive drums 4Y~4B were explained. The result of endurance test in which organic photoconductors (OPC) were used and the sheet transfer belt was cleaned by the first cleaning mode showed that, although many scratches were produced on the surface of the photosensitive drum 4Y when foreign matter is entrained, flaws recognizable by human eyes were not perceived in the transferred images. However, wear were significant on the photosensitive layer of the drum and surface potential decreased, as a result severe fogging happened to the transferred images similarly as was in the case of control shown in FIG. 2.

In the example mentioned above, when performing the first cleaning mode, after cleaning is done by setting the peripheral velocity of the photosensitive drum 4Y~4B to about the same as the transfer speed of the sheet transfer belt 8 (the second control mode), the peripheral velocity of the photosensitive drum 4Y is reduced to about half of the transfer velocity of the sheet transfer belt 8 (the first control mode), and at the same time the photosensitive drums 4C~4B are detached from the sheet transfer belt 8, it is also suitable in the first cleaning mode that the peripheral velocity of the photosensitive drum 4Y is set to about half of the transfer velocity of the sheet transfer belt 8 and at the same time the photosensitive drums 4C~4B are detached from the sheet transfer belt 8 from the beginning of cleaning (i.e. it is suitable to allow only the firstcontrol mode to be done).

In this way, by performing cleaning of the sheet transfer belt 8 by setting the peripheral velocity of the photosensitive drum 4Y to about half of the sheet transfer velocity of the sheet transfer belt 8 and detaching the photosensitive drums 4C~4B from the sheet transfer belt 8, the sheet transfer belt 8 can be fully cleaned. Moreover, even if a scratch is produced, yellow is difficult to be perceived by human eyes, so it is hardly be sensed as a flaw in the transferred image by human eyes and flaws can be practically prevented from appearing in the transferred image.

By the cleaning by setting the peripheral velocity of the photosensitive drum 4Y to about the same as the transfer velocity of the sheet transfer belt 8 as mentioned above before the peripheral velocity of the photosensitive drum 4Y is changed to about half of the transfer velocity of the sheet transfer belt 8 and at the same time the photosensitive drums 4C~4B are detached from the sheet transfer belt 8, foreign matter adhered electrostatically to the sheet transfer belt 8 is transferred to either of the photosensitive drums 4Y~4B, and generation of scratches can be prevented or suppressed to a minimum. After this, cleaning is done by changing the peripheral velocity of the photosensitive drum 4Y to about half of the transfer velocity of the sheet transfer belt 8, so foreign matter remained on the sheet transfer belt 8 is removed (reversely transferred) and flaws in the transferred images cannot be sensed as flaws even if scratches are generated, for yellow is difficult to be perceived by human eyes.

In the above example, although the peripheral velocity of only the photosensitive drum 4Y is controlled at about half of the transfer velocity of the sheet transfer belt 8, it was approved that, in an image forming apparatus transferring several colors, a result similar to that mentioned above can be achieved by allowing the velocity difference between the peripheral velocity of the highest spectroreflectivity image carrying photosensitive drum and the transfer velocity of the sheet transfer belt 8 is set to about 20% or larger.

It is not necessarily needed to set the peripheral velocity of the highest photosensitive drum to about half of the transfer velocity of the sheet transfer belt 8, it is permissible to control the peripheral velocity of the highest spectroreflectivity image carrying photosensitive drum so that the velocity difference between the peripheral velocity of the highest spectroreflectivity image carrying photosensitive drum and the transfer velocity of the sheet transfer belt 8 to be larger than a predetermined value (the velocity difference when the peripheral velocity of the photosensitive drum 4Y is about the same as the transfer velocity of the sheet transfer belt 8, and this velocity difference being larger than zero).

Although in the above-mentioned example the photosensitive drums 4C~4B except the photosensitive drum 4Y are detached from the sheet transfer belt 8, it is suitable to detach at least only the photosensitive drum 4B from the sheet transfer belt 8. (When only the photosensitive drum 4B is detached from the sheet transfer belt 8, the peripheral velocity of the photosensitive drums 4C and 4M is controlled to be about the same as the transfer velocity of the sheet transfer belt 8.) By detaching the photosensitive drum 4B from the sheet transfer belt 8, scratches are not produced on the surface of the photosensitive drum 4B even if foreign matter is entrained and flaws do not appear in the transferred image, in spite of that black toner is easily discerned by human eyes. In an image transfer apparatus transferring images of several colors, it is suitable to allow the lowest spectroreflectivity image carrying photosensitive drum to be detached from the sheet transfer belt 8.

That is, in the above-mentioned example, by allowing the velocity difference between the peripheral velocity of the highest spectroreflectivity image carrying photosensitive drum and the transfer velocity of sheet transfer belt 8 to be larger than a predetermined value (the velocity difference when the peripheral velocity of the photosensitive drum 4Y is about the same as the transfer velocity of the sheet transfer belt 8, and this velocity difference being larger than zero) and allowing at least the lowest spectroreflectivity image carrying photosensitive drum to be detached from the sheet transfer belt 8 when performing cleaning the sheet transfer belt 8, the cleaning can be done well enough, and even if foreign matter is entrained, flaws do not be perceived in the transferred image.

In the above-mentioned example, the image transfer units 30Y, 30C, 30M, and 30B are arranged from upstream toward downstream in this ordering, it is permissible to arrange them in any other ordering. However, by arranging such that the image forming unit 30Y is located most upstream and the unit 30B most downstream or that the image forming unit 30B is located most upstream and the unit 30Y most downstream, controlling becomes easy to detach the image forming units 30~30B from the sheet transfer belt 8.

Figure 5:
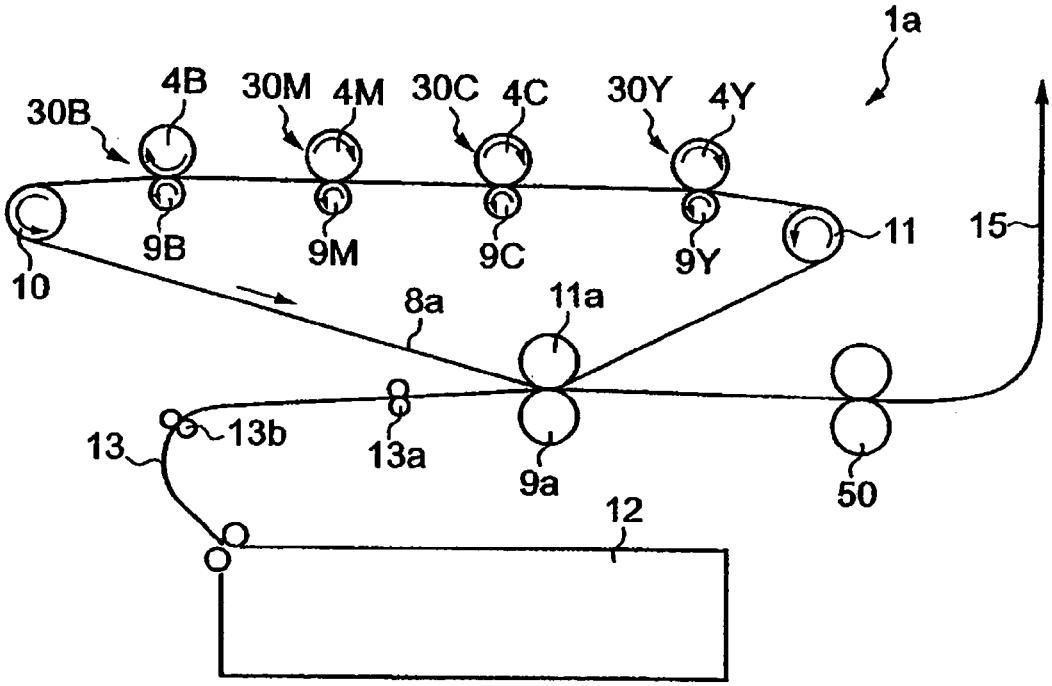
FIG. 5 is a schematic representation of another embodiment of the image forming apparatus according to the present invention.
Figure 6:
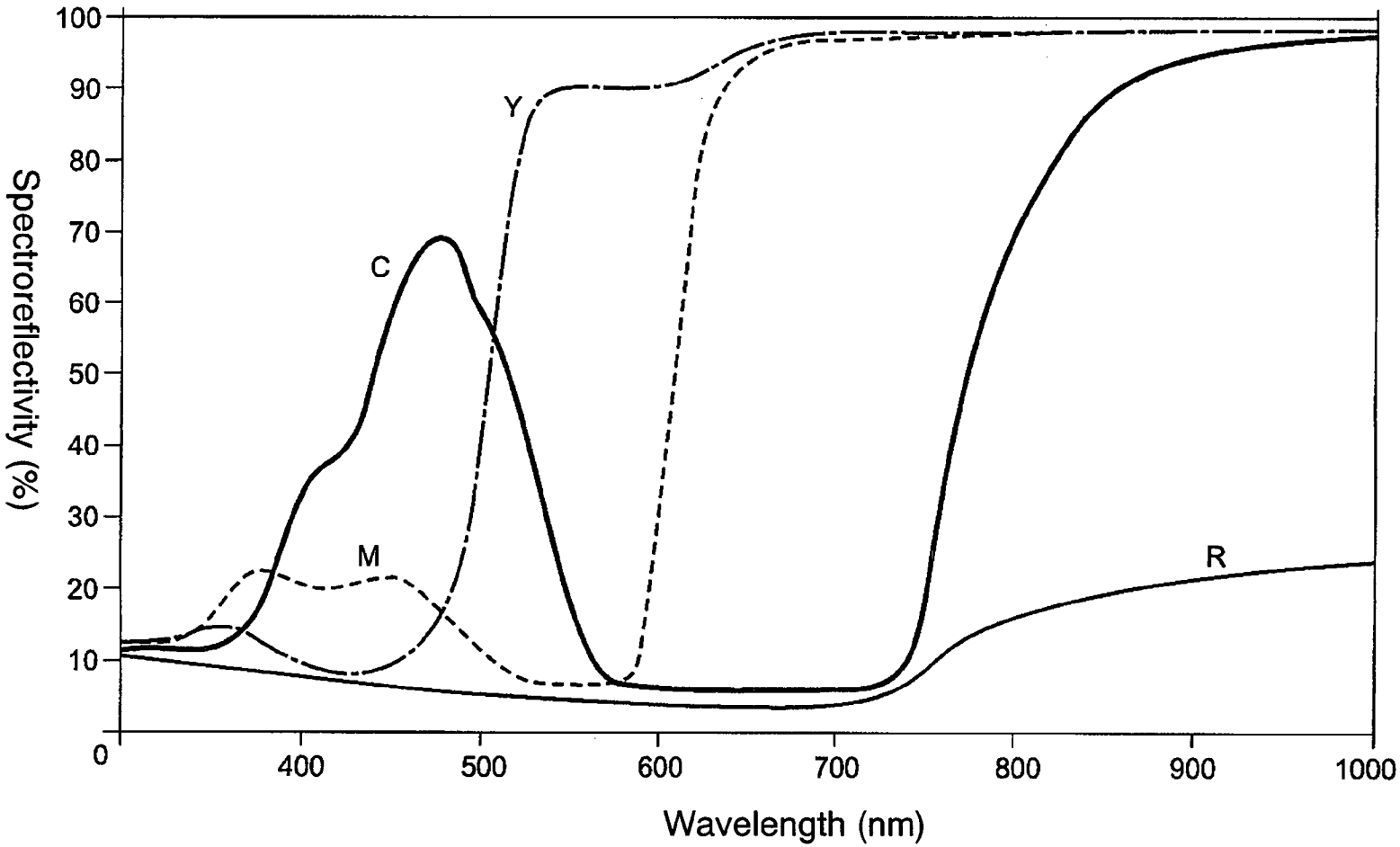
FIG. 6 is a graph showing spectroreflection characteristic of color toner.

FIG. 5 is a schematic representation of another embodiment showing an example of the intermediate tandem type color printer 1*a* used as an image forming apparatus. In a color printer 1*a*, constituents similar to the color printer 1 of FIG. 1 are indicated by the same reference marks. In FIG. 5, transfer rollers 9Y~9B are primary transfer rollers. As to image transfer unit 30Y~30B, only photosensitive drums 4Y~4B are shown, and toner containers 7Y~7B are omitted.

An intermediate transfer belt 8*a* (intermediate transfer body) is looped over a driving roller 10, a follower roller 11, an opposite-side roller 11*a*, and driven by the driving roller 10 to travel in the direction shown by the arrow in FIG. 5. The intermediate transfer belt 8*a* is for example made of nylon group resin added with carbon black to adjust electric conductivity.

When forming color images, as explained referring to FIG. 1, the photosensitive drums 4Y~4B are arranged to face the primary transfer roller 9Y~9B across the intermediate transfer belt 8*a* pinching the intermediate transfer belt 8*a* with the transfer rollers 9Y~9B respectively. Transfer bias voltage is applied to each of the transfer rollers 9Y~9B to transfer the toner image on each of the photosensitive drums 4Y~4B sequentially to the intermediate transfer belt 8*a* to be superimposed on the intermediate transfer belt 8*a*, and a color image is formed on the intermediate transfer belt 8*a* (primary transferring). Then, the primary transferred image on the intermediate transfer belt 8*a* is conveyed by the traveling of the belt 8*a* to the position for secondary image transfer.

At the secondary image transfer position, a secondary transfer roller 9*a* faces the opposing-side roller 11*a* across the intermediate transfer belt 8*a* pinching the belt 8*a* with the opposing-side roller 11*a*. A sheet paper is fed from the sheet cassette 12 via a sheet paper passage 13 to a pair of registration rollers 13*a*, whereby the sheet paper adjusted in feed timing to be fed to the secondary transfer position with appropriate timing. A prescribed transfer bias voltage is applied to the secondary transfer roller 9*a* and the primary transferred image on the intermediate transfer belt 8*a* is transferred to a sheet paper(secondary image transfer). The sheet paper is transferred to a fusing device 50 where the color image is fixated and discharged to via a sheet paper discharge passage 15.

When performing the first control as shown in FIG. 2 for the embodiment of FIG. 5, the intermediate transfer belt 8*a* is cleaned by the first cleaning mode or second cleaning mode selectively as explained referring to FIG. 2.

For example, when cleaning is performed by the second cleaning mode as shown in FIG. 3, peripheral velocity of each of the photosensitive drums 4Y~4B set at v1=129.61 mm/s, transfer velocity of the intermediate transfer belt 8*a* is set to v2=130.00 mm/s, that is, the peripheral velocity of each of the photosensitive drums 4Y~4B is set to about the same as the transfer velocity of the intermediate transfer belt 8*a* (line speed difference being 0.3%). After color drift and image density are corrected and jammed sheet paper is treated, cleaning of the first cleaning mode is performed automatically or manually when the contamination of the rear side of sheet paper is conspicuous, whereby a reverse transfer bias voltage is applied to the primary transfer roller 9Y facing the photosensitive drum 9Y in the state the photosensitive drum 9Y is not charged, with the peripheral velocity of only the photosensitive drum 9Y reduced to about half of the transfer velocity of the intermediate transfer belt 8*a*, the reverse bias voltage being opposite in polarity to that of the bias voltage which is applied to the primary transfer rollers when images are transferred to the intermediate transfer belt.

Now assuming that the width a at the transfer nip is 1.5 mm, the time dt for the intermediate transfer belt 8*a* to pass over the transfer nip is 0.0115 seconds. In the second cleaning mode, length dL of a scratch produced by entrained foreign matter is: $dL=a\times(v2-v1)/v2=0.0045$ mm. As mentioned before, with resolution of 600 dpi, the length of a pixel is 42 μm, and scratches that cause flaws do not appear in transferred images. On the other hand, in the first cleaning mode, as the peripheral velocity of the photosensitive drum 4Y is reduced to about half of the transfer velocity of the intermediate transfer belt 8*a*, scratch length dL is: $dL=a\times(v2-v1)/v2=0.752$ mm. Although the length of scratch is increased, yellow toner is used on the photosensitive drum 4Y, so it is difficult to discern the scratch by human eyes, that is, visual sensibility of yellow is extremely low and the scratch may hardly be recognized as a flaw by human eyes.

Another test was carried out for comparison while cleaning the intermediate transfer belt 8*a* by setting the peripheral velocity of the photosensitive drums 4Y~4B at the same velocity and setting the transfer velocity of the intermediate transfer belt 8*a* at 2 times the peripheral velocity of the photosensitive drums 4Y~4B. The result was that, although cleaning was well enough, scratches of about 700~800 μm were produced on the surface of the photosensitive drums 4Y~4B and flaws recognizable by human eyes were perceived in the transferred image.

With the example of FIG. 5, the case of using a-Si photosensitive drums for the photosensitive drums 4Y=4B has been explained. The result of endurance test in which organic photoconductors (OPC) were used instead of a-Si photosensitive drums and cleaning was performed by the first cleaning mode showed that, although many scratches were produced on the surface of the photosensitive drum 4Y when foreign matter is entrained, flaws recognizable by human eyes were not perceived in the transferred images. However, wear were significant on the surface of the photosensitive layer of the drum and surface potential decreased, as a result severe fogging happened to the transferred images.

Another test was carried out by using organic photoconductors (OPC) for comparison while cleaning the intermediate transfer belt 8*a* by setting the peripheral velocity of the photosensitive drums 4Y~4B at the same velocity to each other and setting the transfer velocity of the intermediate transfer belt 8*a* at 2 times the peripheral velocity of the photosensitive drums 4Y~4B. The test result proved that many scratches were produced on the surfaces of the photosensitive drums 4Y~4B when foreign matter is entrained, flaws recognizable by human eyes were perceived in the transferred images, wear were significant on the photosensitive layers of the drums and surface potential decreased, as a result severe fogging happened to the transferred images.

Other control operations in the first cleaning mode are similar to the case of the printer 1 explained before and explanation is omitted.

When the second control as shown in FIG. 3 and FIG. 4 is performed with the embodiment of FIG. 5, the first cleaning or second cleaning is performed selectively also in the printer 1*a* of FIG. 5 to clean the intermediate transfer belt 8*a* as explained referring FIG. 3 and FIG. 4.

In the case of FIG. 4 of the second cleaning mode, peripheral velocity v1 of the photosensitive drum 4Y~4B is 129.61 mm/s, transfer velocity v2 of the intermediate transfer belt 8*a* is 130.00 mm/s for example, that is, the velocity of each of the photosensitive drum 4Y~4B is set to about the same as the transfer velocity of the intermediate transfer belt 8*a* (line velocity difference being 0.3%). After color drift and image density are corrected and jammed sheet paper is treated, cleaning of the first cleaning mode is performed automatically or manually when the contamination of the rear side of sheet paper is conspicuous, whereby when the first control mode is operated, the peripheral velocity of the photosensitive drum 4Y is reduced to about half of the transfer velocity of the intermediate transfer belt 8*a* and at the same time the photosensitive drum 4C~4B are detached from the intermediate transfer belt 8*a*.

Now, assuming that the width a at the transfer nip is 1.5 mm, the time dt for the intermediate transfer belt 8*a* to pass over the transfer nip is 0.0115 seconds. In the second cleaning mode, length dL of a scratch produced by entrained foreign matter is: $dL=1.5\times(v2-v1)/v2=0.0045$ mm. As mentioned before, with resolution of 600 dpi, the length of a pixel is 42 μm, and scratches that cause flaws do not appear in transferred images. On the other hand, in the first cleaning mode, as the peripheral velocity of the photosensitive drum 4Y is reduced to about half of the transfer velocity of the intermediate transfer belt 8*a*, scratch length dL is: $dL=1.5\times(v2-v1)/v2=0.752$ mm. Although the length of scratch is increased, as yellow toner is used on the photosensitive drum 4Y, it is difficult to discern the scratch by human eyes, that is, visual sensibility of yellow is extremely low and the scratch may hardly be recognized as a flaw by human eyes.

What is claimed is:

1. An image forming method in an image forming apparatus provided with a plurality of image forming units having image carrying bodies for carrying toner images of several colors, the image forming units being arranged along a transfer body for transferring recording medium, and a plurality of image transfer means each faces each of said image carrying body across said image transfer body pinching the image transfer body, wherein when cleaning off the toner remaining on said transfer body, a first speed control is done to allow the peripheral velocity of an image carrying body on which a toner image of which the spectroreflectivity at wavelength of 550 nm is the highest is to be formed to be different from the transfer velocity of said transfer body in a state a bias voltage is applied to the transfer means corresponding to said image carrying body on which a toner image of which the spectroreflectivity at wavelength of 550 nm is the highest is to be formed, the polarity of said bias voltage being opposite to that of a bias voltage that is applied when the image of which the spectroreflectivity at wavelength of 550 nm is the highest is transferred to said recording medium.

2. The image forming method according to claim 1, wherein before performing said first speed control a second speed control by which each peripheral velocity of all the image carrying bodies is allowed to be about the same as the transfer velocity of the transfer body is performed.

3. The image forming method according to claim 1, wherein said first speed control is performed and at least the image carrying body on which a toner image of which the spectroreflectivity at wavelength of 550 nm is the lowest is to be formed is detached from the transfer body.

4. An image forming apparatus provided with a plurality of image forming units having a plurality of image carrying bodies for carrying toner images of several colors, the image forming units being arranged along a transfer body for transferring recording medium, and a plurality of image transfer means each faces each of said image carrying body across said image transfer body pinching the image transfer body, wherein are provided a reverse bias applying means for applying to at least one of the transfer means bias voltage opposite in polarity to that applied to when the image on the image carrying body is transferred to the recording medium, and a control means which can perform speed control of a first speed control mode for controlling the peripheral velocity of an image carrying body on which a toner image of which the spectroreflectivity at wavelength of 550 nm is the highest is to be formed to be different from the transfer velocity of said transfer body when cleaning off the toner remaining on said transfer body.

5. The image forming apparatus according to claim 4, wherein before performing said first speed control said control means can perform a second speed control mode by which peripheral velocities of all the image carrying bodies are allowed to be about the same as the transfer velocity of the transfer body when cleaning off the toner remaining on the transfer body.

6. The image forming apparatus according to claim 4, wherein said first speed control mode is to control so that the velocity difference between the peripheral velocity of an image carrying body on which a toner image of which the spectroreflectivity at wavelength of 550 nm is the highest is to be formed and the transfer velocity of the transfer body is larger than a predetermined value, and to control to allow to detach from the transfer body at least an image carrying body on which a toner image of which the spectroreflectivity at wavelength of 550 nm is the lowest is to be formed is detached from the transfer body.

7. The image forming apparatus according to claim 6, wherein when in said first speed control mode only the image carrying body on which a toner image of which the spectroreflectivity at wavelength of 550 nm is the lowest is to be formed is detached from the transfer body, said control means controls so that the peripheral velocity of each of the image carrying bodies except the image carrying body on which a toner image of which the spectroreflectivity at wavelength of 550 nm is the lowest is to be formed is about the same as the velocity of the transfer body.

8. The image forming apparatus according to claim 4, wherein said first speed control mode is to control to allow the velocity difference between the peripheral velocity of an image carrying body on which a toner image of which the spectroreflectivity at wavelength of 550 nm is the highest is to be formed and the transfer velocity of the transfer body to be larger than a predetermined value and to control to allow the peripheral velocity of at least an image carrying body on which a toner image of which the spectroreflectivity at wavelength of 550 nm is the lowest is to be formed to be about the same as the transfer velocity of the transfer body.

9. The image forming apparatus according to claim 7 or 8, wherein the toner image of which spectroreflectivity at wavelength of 550 nm is the highest is formed with yellow toner and the toner image of which spectroreflectivity at wavelength of 550 nm is the lowest is formed with black toner.

10. The image forming apparatus according to claim 4, wherein said opposite polarity bias voltage is applied to the transfer body corresponding to the image carrying body on which said toner image of which spectroreflectivity at wavelength of 550 nm is the highest is formed.

11. The image forming apparatus according to claim 4, wherein amorphous silicon photoconductor is used for said image carrying body.

* * * * *